US009152082B2

(12) United States Patent
Itabashi

(10) Patent No.: US 9,152,082 B2
(45) Date of Patent: Oct. 6, 2015

(54) CARTRIDGE HAVING CONTACT MEMBER TO MITIGATE DAMAGE TO CARTRIDGE FRAME

(71) Applicant: Nao Itabashi, Nagoya (JP)

(72) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 47 days.

(21) Appl. No.: 14/032,241

(22) Filed: Sep. 20, 2013

(65) Prior Publication Data

US 2014/0086635 A1 Mar. 27, 2014

(30) Foreign Application Priority Data

Sep. 21, 2012 (JP) ..... 2012-208915

(51) Int. Cl.
*G03G 15/08* (2006.01)

(52) U.S. Cl.
CPC ..... *G03G 15/0865* (2013.01); *G03G 15/0896* (2013.01); *G03G 15/0898* (2013.01)

(58) Field of Classification Search
CPC ..... G03G 15/0865; G03G 15/0896; G03G 15/0898
USPC ..... 399/111, 119
See application file for complete search history.

(56) References Cited

U.S. PATENT DOCUMENTS

| | | | | |
|---|---|---|---|---|
| 6,101,350 | A * | 8/2000 | Suzuki et al. | 399/113 |
| 6,546,217 | B2 * | 4/2003 | Okabe et al. | 399/113 |
| 7,369,797 | B2 * | 5/2008 | Yoshida et al. | 399/256 |
| 7,643,774 | B2 * | 1/2010 | Choi | 399/126 |
| 7,689,139 | B2 * | 3/2010 | Kamimura | 399/90 |
| 8,577,244 | B2 * | 11/2013 | Takagi et al. | 399/90 |
| 2003/0202817 | A1 * | 10/2003 | Higeta et al. | 399/109 |
| 2007/0177894 | A1 * | 8/2007 | Nakano et al. | 399/121 |
| 2011/0206410 | A1 * | 8/2011 | Okabe | 399/111 |

FOREIGN PATENT DOCUMENTS

JP 2009-042327 A 2/2009

* cited by examiner

*Primary Examiner* — Francis Gray
(74) *Attorney, Agent, or Firm* — Banner & Witcoff, Ltd.

(57) ABSTRACT

A cartridge includes: a frame defining a chamber for storing developer therein; a rotary body configured to be rotatably supported to the frame; and a contact member. The rotary body includes: a metal shaft extending in an axial direction, the frame extending in the axial direction; and a cover portion made of an elastic material and provided around the metal shaft to expose shaft end portions thereof, the cover portion having a cover-portion end portion positioned inward of the frame in the axial direction. The contact member is provided on the metal shaft and disposed between the cover-portion end portion and the frame in the axial direction such that the contact member is in contact with each of the cover-portion end portion and the frame.

14 Claims, 10 Drawing Sheets

FRONT
TOP
LEFT
REAR
RIGHT
BOTTOM
TOP
FRONT
REAR
BOTTOM
100
35
62
69
56(39)
63
68
60
64
40
30
16
36
42
37
43
49
44
55(39)
73
70
74
45
76
A
75
61
101
72
31
51
34
52
Z
53
38
32
47
Y
X
28
50
27
48
25
46

CARTRIDGE HAVING CONTACT MEMBER TO MITIGATE DAMAGE TO CARTRIDGE FRAME

CROSS REFERENCE TO RELATED APPLICATION

This application claims priority from Japanese Patent Application No. 2012-208915 filed Sep. 21, 2012. The entire content of the priority application is incorporated herein by reference.

TECHNICAL FIELD

The present invention relates to a cartridge mountable in an electrophotographic image forming apparatus.

BACKGROUND

A conventional electrophotographic image forming apparatus detachably accommodates developing cartridges therein. Such a developing cartridge includes a cartridge frame for accommodating toner, and a developing roller supported in the cartridge frame.

One developing cartridge that has been proposed includes a developing roller configured of a metal developing-roller shaft, and a rubber roller covering the developing-roller shaft while leaving left and right ends of the shaft exposed. A bearing member is fixed by screws to a right wall of a cartridge frame for receiving and rotatably holding the right end of the developing-roller shaft (see Japanese Patent Application Publication No. 2009-042327, for example).

In this developing cartridge, the right endface of the rubber roller confronts but is separated from the right wall of the cartridge frame in a direction along the developing-roller shaft (hereinafter referred to as the "axial direction"). The bearing member restricts the developing roller from moving outward in the axial direction (rightward) relative to the cartridge frame.

SUMMARY

One issue that must be considered is that a user could inadvertently drop a developing cartridge when mounting the cartridge in or removing the cartridge from an image forming apparatus, for example. If the developer cartridge having the above conventional structure is dropped such that the right wall of the cartridge frame impacts the floor or the like, the inertia of the cartridge will produce an inertial force acting on the developing roller to move the roller outward in the axial direction.

Consequently, the developing roller may move outward in the axial direction relative to the cartridge frame.

This inertial force (load) produced by a relatively large and heavy developing roller acts on the bearing member receiving the right end of the developing-roller shaft and also acts on the right wall of the cartridge frame through the bearing member and the screws. Consequently, this type of accident could damage the bearing member and/or the right wall of the cartridge frame. Damage to the bearing member and/or right wall of the cartridge frame might allow the developing roller to break out of the cartridge frame and, hence, allow toner to leak from the cartridge frame.

In view of the foregoing, it is an object of the present invention to provide a cartridge having a frame that is unlikely to become damaged, even when the cartridge is inadvertently dropped, and that can reduce the likelihood of developer leaking out of the frame.

In order to attain the above and other objects, there is provided a cartridge including: a frame, a rotary body and a contact member. The frame defines a chamber for storing developer therein. The rotary body is configured to be rotatably supported to the frame, wherein the rotary body includes a metal shaft and a cover portion. The metal shaft extends in an axial direction and has axial end portions rotatably supported to the frame, the frame extending in the axial direction. The cover portion is made of an elastic material and provided around the metal shaft to expose the axial end portions thereof, the cover portion having a first axial end portion positioned inward of the frame in the axial direction. The contact member is provided on the metal shaft and disposed between the first axial end portion and the frame in the axial direction such that the contact member is in contact with each of the first axial end portion and the frame.

DETAILED DESCRIPTION

1. Overall Structure of Printer

Figure 1:
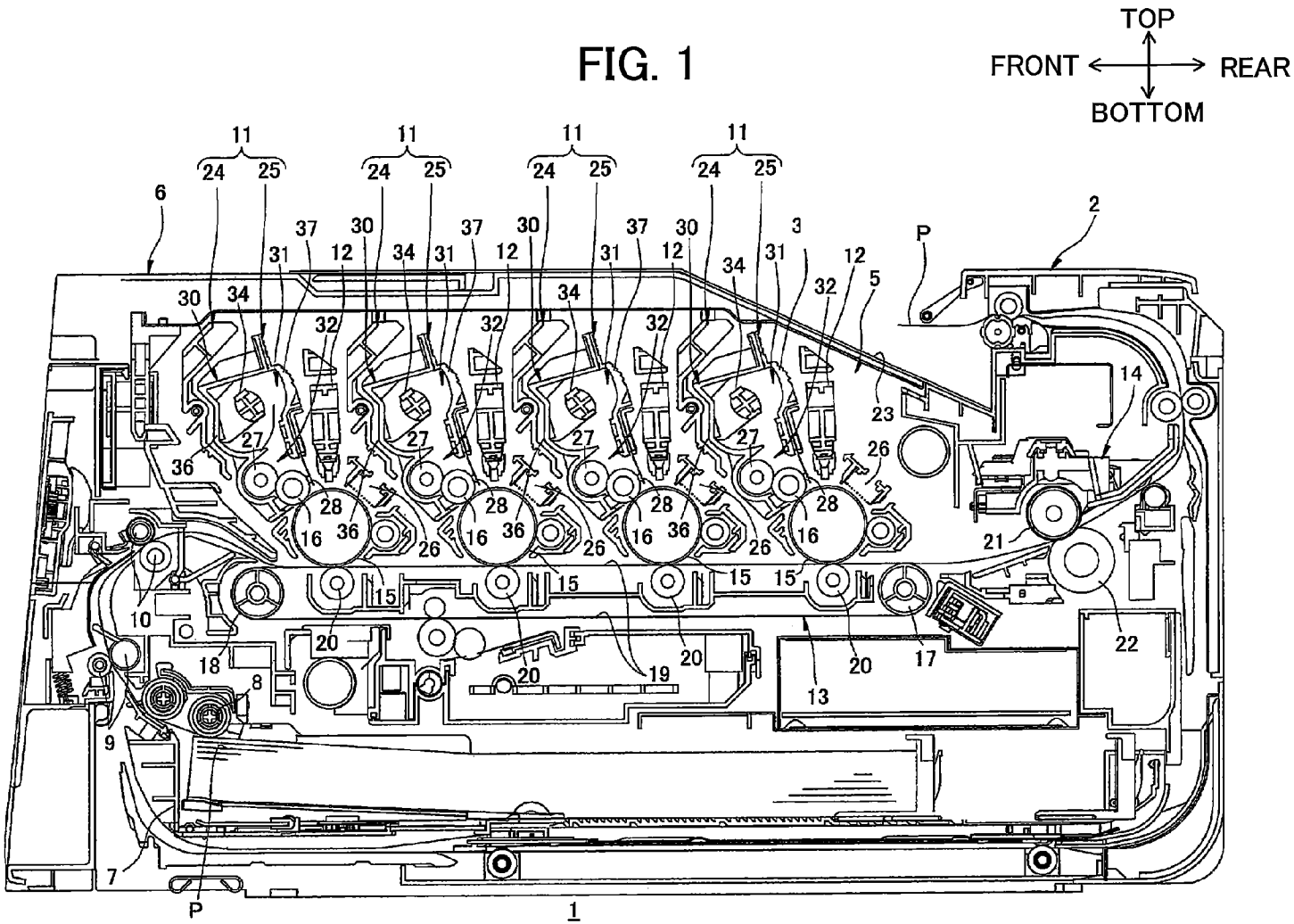
FIG. 1 is a vertical cross-sectional view of a printer that accommodates a developing cartridge according to a first embodiment of the present invention.

A printer 1 is a direct horizontal tandem-type color printer, as shown in FIG. 1. The printer 1 is an example of an image-forming apparatus in which developing devices according to a first embodiment of the present invention are detachably accommodated.

In the following description, directions related to the printer 1 will be given under an assumption that the printer 1 is resting on a level surface, and particularly will correspond to the directions of arrows indicated in accompanying drawings.

The printer 1 includes a main casing 2 that has a box-like shape. An access opening 5 is formed in a top portion of the main casing 2. A top cover 6 is pivotably disposed on the top portion of the main casing 2 over the access opening 5 and is capable of pivoting about its rear edge to expose or cover the access opening 5.

The printer 1 also includes four process cartridges 11. The process cartridges 11 are disposed in parallel and spaced at intervals in a front-rear direction. The process cartridges 11 are provided for each of four colors (black, yellow, magenta, and cyan).

Each of the process cartridges 11 includes a drum cartridge 24, and a developing cartridge 25 detachably mountable in the drum cartridge 24. The drum cartridge 24 is detachably mountable in the main casing 2.

The drum cartridge 24 is provided with a photosensitive drum 15, and a Scorotron charger 26.

The photosensitive drum 15 has a general cylindrical shape, with its axis aligned in a left-right direction. The photosensitive drum 15 is rotatably disposed in the drum cartridge 24.

The Scorotron charger 26 is disposed so as to confront the photosensitive drum 15 from an upper-rear side thereof.

The developing cartridge 25 is provided with a developing roller 16, a supply roller 27, and a thickness-regulating blade 28. The developing cartridge 25 also accommodates toner that is stored in a portion above the developing roller 16, supply roller 27 and thickness-regulating blade 28.

The developing roller 16 has a general columnar shape that is elongated in the left-right direction. The developing roller 16 contacts the photosensitive drum 15 from an upper-front surface thereof. The developing roller 16 is rotatably supported to a lower end portion of the developing cartridge 25 so as to be exposed rearward therefrom.

The supply roller 27 is configured to supply toner to the developing roller 16. The thickness-regulating blade 13 serves to regulate a thickness of toner carried on a peripheral surface of the developing roller 16.

The toner accommodated in the developing cartridge 25 is supplied to the supply roller 27, and tribocharged with a positive polarity between the supply roller 27 and developing roller 16 when supplied onto the surface of the developing roller 16. The thickness-regulating blade 13 then maintains the toner carried on the surface of the developing roller 16 at a thin layer of uniform thickness, as the developing roller 16 rotates.

In the meantime, the Scorotron charger 26 applies a uniform charge to a peripheral surface of the photosensitive drum 15. Subsequently, an LED unit 12 disposed above and in confrontation with the photosensitive drum 15 irradiates light onto the surface of the photosensitive drum 15 based on prescribed image data, forming an electrostatic latent image on the surface. Next, the toner carried on the surface of the developing roller 16 is supplied to the latent image formed on the surface of the photosensitive drum 15, developing the latent image into a toner image.

Sheets P of paper are accommodated in a paper tray 7 provided in a bottom section of the main casing 2. A pick-up roller 8, sheet-feed roller 9, and a pair of registration rollers 10 convey the sheets P along a U-shaped path for redirecting the sheets P upward and rearward, and supply the sheets P one at a time between the photosensitive drums 15 and a conveying belt 19 at a prescribed timing.

The conveying belt 19 continues to convey each sheet P rearward between each of the photosensitive drums 15 and a corresponding transfer roller 20. At this time, toner images of all four colors formed on the photosensitive drums 15 are sequentially transferred onto the sheet P.

The sheet P subsequently passes between a heating roller 21 and a pressure roller 22. The heating roller 21 and pressure roller 22 apply heat and pressure, respectively, to the sheet P for fixing the color toner image. Next, the sheet P is conveyed along a U-shaped path that redirects the sheet P upward and forward, and the sheet P is discharged onto a discharge tray 23 provided on the top cover 6.

2. Detailed Structure of Developer Cartridge

Figures 2A, 2B:
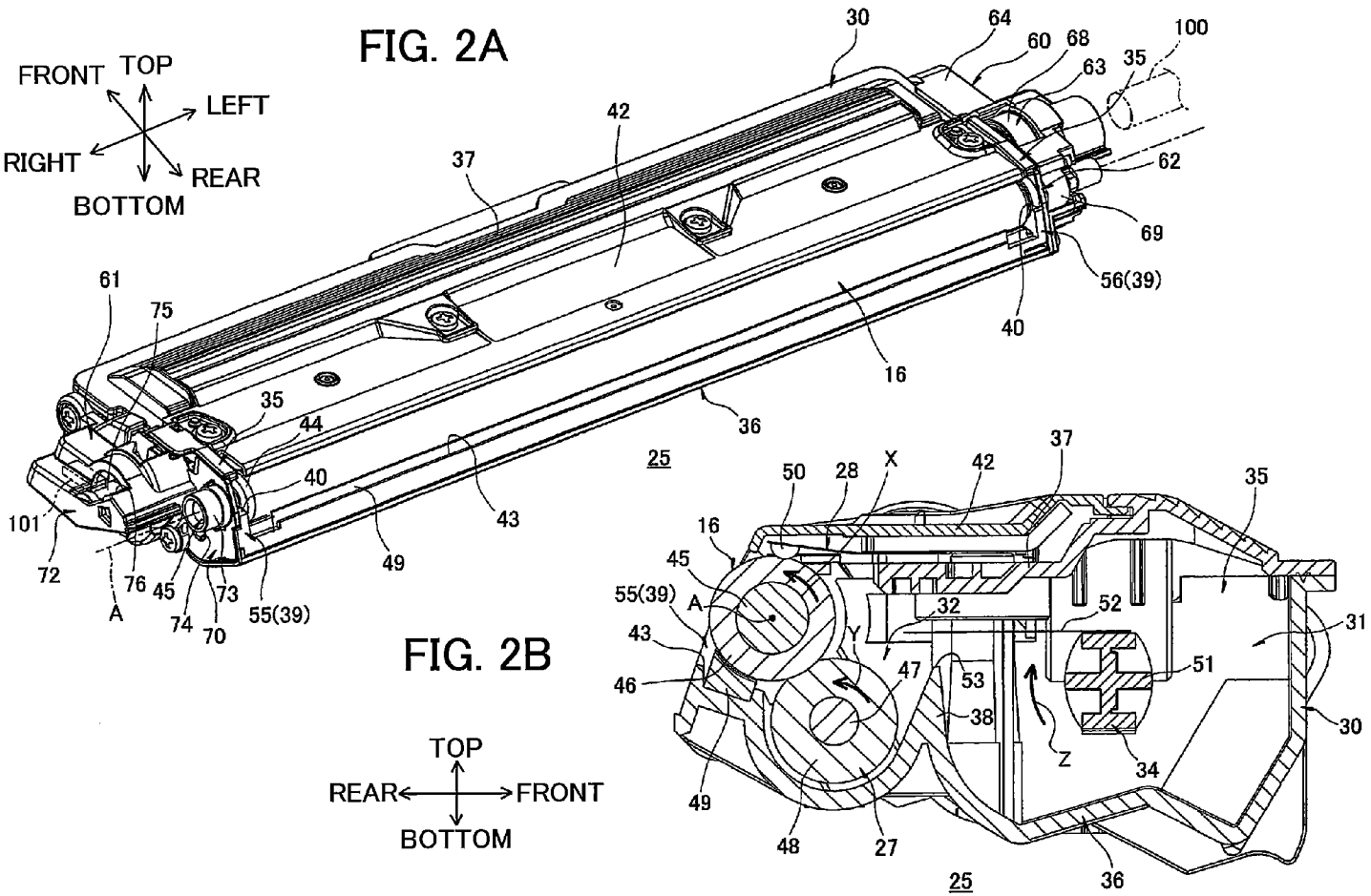
FIG. 2A is a perspective view of the developing cartridge of FIG. 1 as viewed from its upper-right side, the developing cartridge including a developing roller, a thickness regulating blade, a blade cover and a contact member according to the first embodiment.
FIG. 2B is a cross-sectional side view of the developing cartridge of FIG. 2A.

As shown in FIGS. 2A and 2B, the developing cartridge 25 includes a cartridge frame 30.

When giving directions in the following description of the developing cartridge 25, the side of the developing cartridge 25 on which the developing roller 16 is disposed (left side in FIG. 2B) will be considered as the rear side, while the opposite side (right side in FIG. 2B) will be considered as the front side. Further, the side of the developing cartridge 25 on which the thickness-regulating blade 28 is disposed (upper side in FIG. 2B) will be considered as the upper side, while the opposite side (lower side in FIG. 2B) will be considered as the lower side. Left and right sides of the developing cartridge 25 will be based on the perspective of a user facing the developing cartridge 25 from the front. Thus, the far side of the developing cartridge 25 in FIG. 2B will be considered as the right side, while the near side of the developing cartridge 25 in FIG. 2B will be considered as the left side. Hence, upward, downward, forward, and rearward directions relative to the developing cartridge 25 differ slightly from those related to the printer 1. That is, the developing cartridge 25 is mounted in the printer 1 and drum cartridge 24 such that the rear side of the developing cartridge 25 is coincident with the lower rear side of the printer 1 and the front side of the developing cartridge 25 is coincident with the upper front side of the printer 1.

As shown in FIG. 2A, the cartridge frame 30 has a box-like shape and is elongated in the left-right direction. The cartridge frame 30 includes a pair of side walls 35, a top wall 37, and a bottom wall 36 (see FIG. 2B).

Figures 3A, 3B:
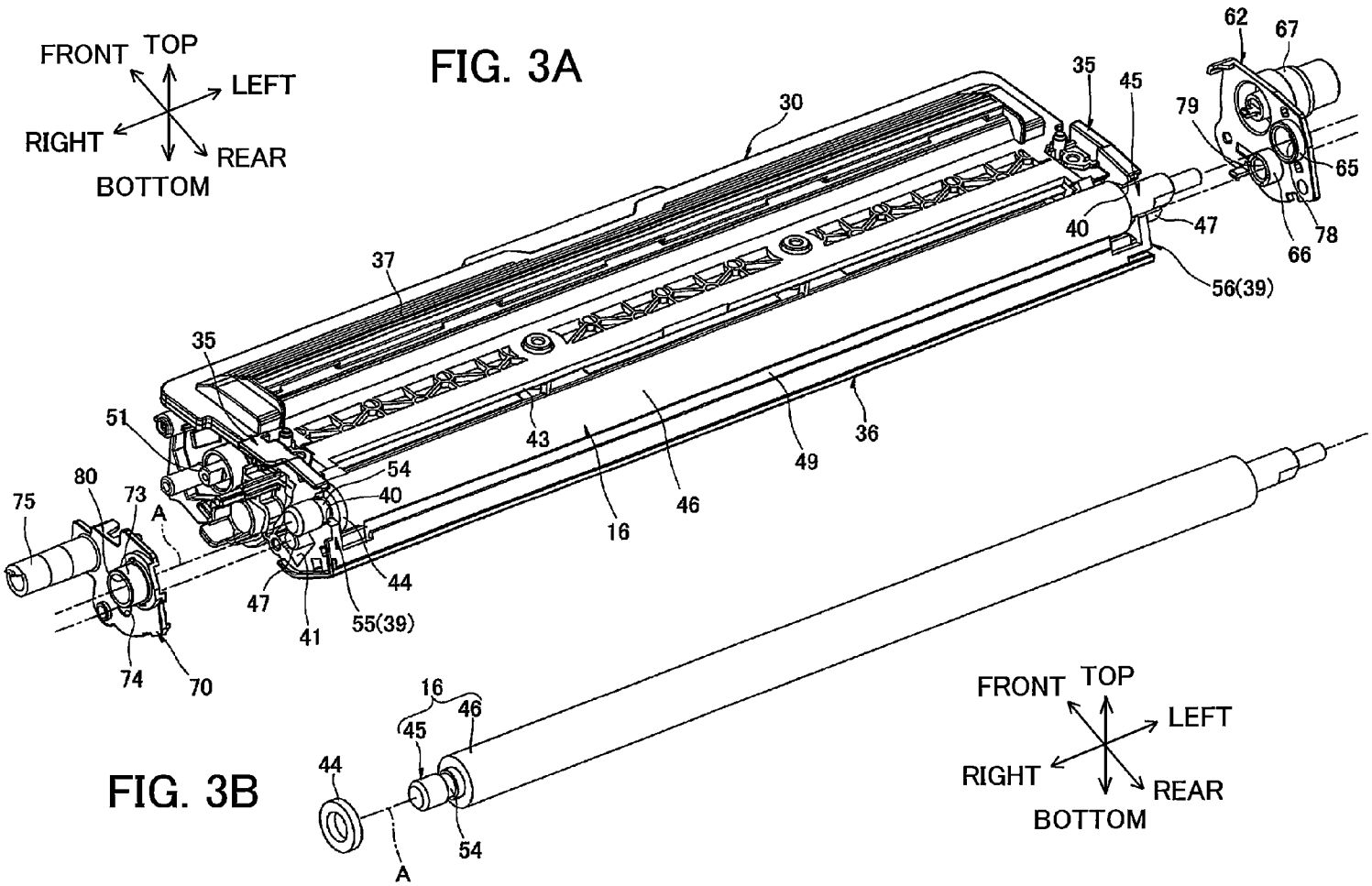
FIG. 3A is an exploded perspective view of the developing cartridge of FIG. 2A as viewed from its upper-right side, wherein the thickness regulating blade and the blade cover are removed from the developing cartridge.
FIG. 3B is an exploded perspective view of the developing roller and the contact member of the first embodiment shown in FIG. 3A.

As shown in FIG. 3A, the side walls 35 have a generally flat plate shape and are substantially rectangular in a side view and elongated in the front-rear direction. The side walls 35 are arranged parallel to each other and are separated in the left-right direction.

The top wall 37 has a generally flat plate shape and is elongated in the left-right direction. The top wall 37 connects upper edges of the side walls 35.

The bottom wall 36 has a generally flat plate shape and is elongated in the left-right direction. The bottom wall 36 connects lower edges of the side walls 35. As shown in FIG. 2B, a partitioning wall 38 is integrally formed with the bottom wall 36 in an approximate front-rear center region thereof.

The partitioning wall 38 protrudes upward from a top surface of the bottom wall 36 and is elongated in the left-right direction. The partitioning wall 38 has a distal edge (top edge) that approaches a bottom surface of the top wall 37 but is separated therefrom. The space formed between the distal edge of the partitioning wall 38 and the bottom surface of the top wall 37 constitutes a through-hole 53.

The interior space of the cartridge frame 30 on the front side of the partitioning wall 38 constitutes a toner-accommodating chamber 31, while the interior space on the rear side of the partitioning wall 38 constitutes a developing chamber 32.

As shown in FIG. 3A, an opening 43 is formed in a rear end portion of the cartridge frame 30 and opens outward toward the rear. The opening 43 is specifically defined by the rear edges of the side walls 35, the rear edge of the top wall 37, and the rear edge of the bottom wall 36.

(1-1) Toner-Accommodating Chamber

As shown in FIG. 2B, the toner-accommodating chamber 31 is specifically defined by front sides of the side walls 35, the top wall 37 (excluding the rear side thereof), the front portion of the bottom wall 36, and the partitioning wall 38. The toner-accommodating chamber 31 accommodates toner. An agitator 34 is disposed in an approximate front-rear and vertical center region of the toner-accommodating chamber 31 for agitating toner.

The agitator 34 includes an agitator shaft 51 aligned in the left-right direction, and an agitating blade 52 extending radially outward from the agitator shaft 51.

The agitator shaft 51 has left and right ends rotatably supported in the corresponding side walls 35, thereby enabling the agitator 34 to rotate relative to the cartridge frame 30. As shown in FIG. 3A, the left and right ends of the agitator shaft 51 protrude outward from the corresponding side walls 35 in respective left and right directions.

(1-2) Developing Chamber

As shown in FIG. 2B, the developing chamber 32 is specifically defined by the rear portions of the side walls 35, the rear end of the top wall 37, the rear portion of the bottom wall 36, and the partitioning wall 38.

As shown in FIG. 3A, the rear portion of each side wall 35 defining the developing chamber 32 constitutes a developing-chamber side wall 39. The developing-chamber side wall 39 on the right side will be called a right developing-chamber side wall 55, while the developing-chamber side wall 39 on the left side will be called a left developing-chamber side wall 56.

A developing-roller-shaft exposing groove 40 and a supply-roller-shaft exposing hole 41 are formed in each of the right developing-chamber side wall 55 and left developing-chamber side wall 56.

The developing-roller-shaft exposing groove 40 has a general U-shape in a side view. The developing-roller-shaft exposing groove 40 is formed in the upper rear edge of each side wall 35 and slopes downward and forward. The developing-roller-shaft exposing groove 40 formed in the right developing-chamber side wall 55 has a width is greater than outer diameters of a developing-roller shaft 45 described later and a small-diameter part 54 described later. The developing-roller-shaft exposing groove 40 formed in the left developing-chamber side wall 56 has a width substantially equal to (slightly greater than) outer diameters of a bearing member 62 described later and a developing-roller-shaft support part 65 described later.

The supply-roller-shaft exposing hole 41 is generally rectangular in a side view and penetrates the developing-chamber side walls 39 at positions diagonally below and forward of the developing-roller-shaft exposing grooves 40. The supply-roller-shaft exposing holes 41 have sides larger than an outer diameter of a supply-roller shaft 47 described later.

As shown in FIGS. 2A and 2B, the developing chamber 32 accommodates the developing roller 16, supply roller 27, and thickness-regulating blade 28, as well as a contact member 44, and a lower sponge 49.

As shown in FIG. 3B, the developing roller 16 is configured of a developing-roller shaft 45, and a rubber roller 46.

The developing-roller shaft 45 is formed of metal and has a general columnar shape that is oriented in the left-right direction. A small-diameter part 54 is formed on a right end of the developing-roller shaft 45.

The small-diameter part 54 is recessed radially inward from the outer peripheral surface of the developing-roller shaft 45 to conform to the developing-roller-shaft exposing groove 40 formed in the right developing-chamber side wall 55. Hence, the outer diameter of the small-diameter part 54 is smaller than that of the developing-roller shaft 45. The left-right dimension of the small-diameter part 54 is approximately equivalent to the left-right dimension (thickness) of the developing-chamber side wall 39.

The rubber roller 46 is formed of a rubber material, and specifically silicone rubber. The rubber roller 46 has a generally cylindrical shape and is elongated in the left-right direction. The left-right dimension of the rubber roller 46 is shorter than the left-right length of the developing-roller shaft 45.

Figure 4A:
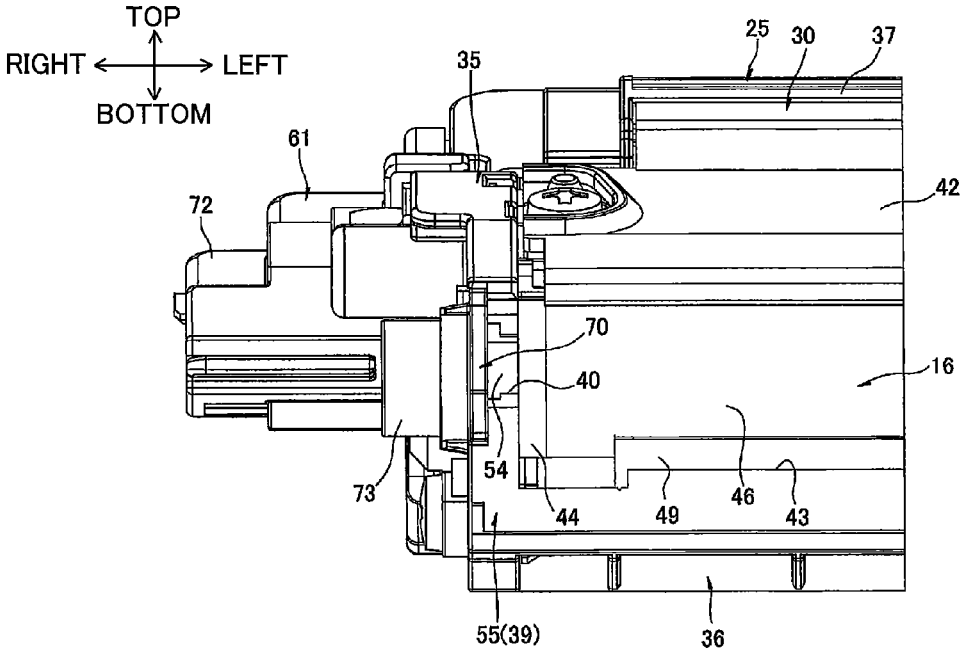
FIG. 4A is a rear view of a right end portion of the developing cartridge of FIG. 2A.
Figure 4B:
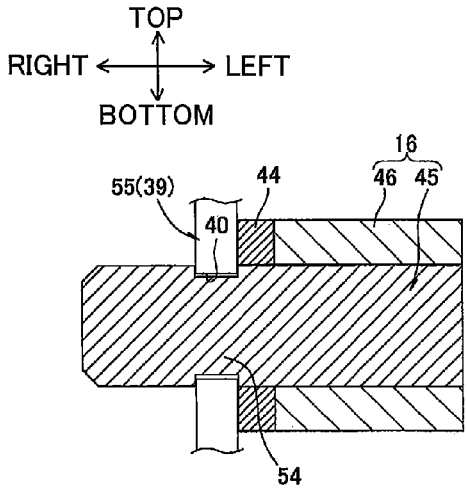
FIG. 4B is a cross-sectional view of the developing roller and the contact member shown in FIG. 4A.

The developing-roller shaft 45 is inserted through an interior space of the rubber roller 46 such that the left and right ends of the developing-roller shaft 45 are exposed on both ends of the rubber roller 46. Accordingly, the rubber roller 46 covers a left-right center region of the developing-roller shaft 45. More specifically, when viewed along a radial direction of the developing-roller shaft 45, as shown in FIG. 4B, the rubber roller 46 is positioned to the left of the small-diameter part 54 constituting the developing-roller shaft 45, with a gap formed between a right endface of the rubber roller 46 and a left edge of the small-diameter part 54.

As shown in FIG. 2A, the developing roller 16 is provided in the cartridge frame 30 so as to be capable of rotating relative to the same by loosely fitting (fitting with play) the small-diameter part 54 of the developing-roller shaft 45 in the developing-roller-shaft exposing groove 40 of the right developing-chamber side wall 55 so that the small-diameter part 54 is rotatable in the developing-roller-shaft exposing groove 40 (see FIG. 4B) and by rotatably supporting the left end of the developing-roller shaft 45 in the developing-roller-shaft exposing groove 40 of the left developing-chamber side wall 56 through the developing-roller-shaft support part 65 (described later; see FIG. 3A). Note that both left and right ends of the developing-roller shaft 45 protrude outward in respective left and right directions from the corresponding developing-chamber side walls 39 (the right developing-chamber side wall 55 and left developing-chamber side wall 56).

As shown in FIG. 3A, the rubber roller 46 is positioned between the right developing-chamber side wall 55 and left developing-chamber side wall 56 with respect to the left-right direction. Specifically, the right endface of the rubber roller 46 confronts the left side (inner side in the axial direction) of the right developing-chamber side wall 55 with a gap formed therebetween, and the left endface of the rubber roller 46 confronts the right side (inner side in the axial direction) of the left developing-chamber side wall 56 with a gap formed therebetween.

In other words, the right developing-chamber side wall 55 confronts the right endface of the rubber roller 46 from the right side thereof (outer side in the axial direction) and is separated from the rubber roller 46 in the left-right direction. Similarly, the left developing-chamber side wall 56 confronts the left endface of the rubber roller 46 from the left side thereof (outer side in the axial direction) and is separated from the rubber roller 46 in the left-right direction. When viewed from the outside in the left-right direction, the right developing-chamber side wall 55 and left developing-chamber side wall 56 overlap the rubber roller 46.

As shown in FIG. 3B, the contact member 44 has a general cylindrical shape and is elongated in the left-right direction. The contact member 44 is formed of POM (polyacetal) resin. The contact member 44 is formed with an inner diameter approximately equal to (slightly greater than) the outer diameter of the developing-roller shaft 45, and an outer diameter approximately equal to the outer diameter of the rubber roller 46. The left-right dimension of the contact member 44 is approximately equal to the left-right distance between the right endface of the rubber roller 46 and the left edge of the small-diameter part 54.

As shown in FIG. 3A, the contact member 44 is fitted around the right end portion of the developing-roller shaft 45 so as to abut the right endface of the rubber roller 46 from the right side thereof. In a right side view, the contact member 44 overlaps the rubber roller 46, with the outer circumference of the contact member 44 flush with the outer circumference of the rubber roller 46.

As shown in FIG. 4B, the contact member 44 is arranged between the right endface of the rubber roller 46 and the left surface of the right developing-chamber side wall 55 (inner surface with respect to the axial direction). The left endface (inner surface in the axial direction) of the contact member 44 contacts the right endface of the rubber roller 46, while the right endface (outer surface in the axial direction) of the contact member 44 contacts the left surface of the right developing-chamber side wall 55.

When the developing roller 16 rotates, the contact member 44 is also caused to rotate together with the developing roller 16 due to friction force generated by the contact of the contact member 44 with the rubber roller 46. That is, the contact member 44 slidingly moves (rotate) relative to the right developing-chamber side wall 55.

As shown in FIG. 2B, the supply roller 27 includes a supply-roller shaft 47, and a sponge roller 48. The supply roller 27 is positioned diagonally below and forward of the developing roller 16 so that the sponge roller 48 confronts and contacts the rubber roller 46 of the developing roller 16.

The supply-roller shaft 47 is formed of a metal and has a general columnar shape that is elongated in the left-right direction.

The sponge roller 48 is formed of an elastic foam material and has a general cylindrical shape that is elongated in the left-right direction. The left-right dimension of the sponge roller 48 is shorter than the left-right length of the supply-roller shaft 47. The supply-roller shaft 47 is inserted into an interior space of the sponge roller 48 such that the left-right ends of the supply-roller shaft 47 are exposed outside the sponge roller 48. Thus, the sponge roller 48 covers a left-right central region of the supply-roller shaft 47.

As shown in FIG. 3A, the supply roller 27 is provided in the cartridge frame 30 so as to be capable of rotating relative thereto by rotatably supporting the right end of the supply-roller shaft 47 in a supply-roller-shaft support hole 74 (described later) of an electrode member 70 (described later) and rotatably supporting the left end of the supply-roller shaft 47 in a supply-roller-shaft support part 66 (described later) of the bearing member 62 (described later). Note that the left end of the supply-roller shaft 47 protrudes further leftward than the bearing member 62 through a supply-roller-shaft insertion hole 79 (described later) formed in the bearing member 62.

As shown in FIG. 2B, the thickness-regulating blade 28 has a generally flat plate shape that is substantially rectangular in a plan view and elongated in the left-right direction. The thickness-regulating blade 28 is formed of a thin flexible metal plate or the like. A contact part 50 is provided on a rear end of the thickness-regulating blade 28.

The contact part 50 is formed of an elastic resin, such as a silicone resin. The contact part 50 is provided on a bottom surface of the thickness-regulating blade 28 at the rear edge thereof and extends across the thickness-regulating blade 28 in the left-right direction. In a side view, the contact part 50 is generally arc-shaped, with the convex side of the arc protruding downward.

The thickness-regulating blade 28 has a front edge fixed to the top surface of the top wall 37 at the rear edge thereof. The contact part 50 contacts the rubber roller 46 of the developing roller 16 from the top.

A blade cover 42 is provided over the top of the thickness-regulating blade 28 to cover the same. As shown in FIGS. 2A and 2B, the blade cover 42 has a generally flat plate shape and is elongated in the left-right direction. The blade cover 42 is fixed to the top surface on the rear portion of the top wall 37 for covering the top of the thickness-regulating blade 28.

The lower sponge 49 has a general rod shape and is elongated in the left-right direction. The lower sponge 49 is interposed between the top surface on the rear portion of the bottom wall 36 and the rubber roller 46 of the developing roller 16.

(1-3) Drive Unit

As shown in FIG. 2A, a drive unit 60 and a power supply unit 61 are provided on the cartridge frame 30.

The drive unit 60 is provided on the left surface of the left side wall 35. The drive unit 60 includes the bearing member 62, a gear train 63, and a drive-side gear cover 64. As shown in FIG. 3A, the bearing member 62 has a generally flat plate shape that is substantially rectangular in a side view. The bearing member 62 is integrally formed of a developing-roller-shaft insertion hole 78, the developing-roller-shaft support part 65, a supply-roller-shaft insertion hole 79, the supply-roller-shaft support part 66, and a coupling support shaft 67.

The developing-roller-shaft insertion hole 78 is formed in an upper portion of the bearing member 62 near the rear edge thereof and penetrates the bearing member 62. The developing-roller-shaft insertion hole 78 has a general circular shape in a side view with an inner diameter that is approximately equal to (slightly larger than) the outer diameter of the developing-roller shaft 45.

The developing-roller-shaft support part 65 has a general cylindrical shape and protrudes rightward from a peripheral edge of the developing-roller-shaft insertion hole 78.

The supply-roller-shaft insertion hole 79 has a general circular shape in a side view and penetrates the bearing member 62 at a position diagonally below and forward of the developing-roller-shaft insertion hole 78. The inner diameter of the developing-roller-shaft insertion hole 78 is approximately equal to (slightly larger than) the outer diameter of the supply-roller shaft 47.

The supply-roller-shaft support part 66 has a general cylindrical shape and protrudes rightward from a peripheral edge of the developing-roller-shaft insertion hole 78.

The coupling support shaft 67 has a general columnar shape and protrudes leftward from the left surface of the bearing member 62 at a position forward of the developing-roller-shaft insertion hole 78.

The bearing member 62 is mounted on the left surface of the left developing-chamber side wall 56, with the left end of the developing-roller shaft 45 inserted into the developing-roller-shaft insertion hole 78 and the left end of the supply-roller shaft 47 inserted into the supply-roller-shaft insertion hole 79. As a result, the developing-roller-shaft support part 65 of the bearing member 62 is inserted into the developing-roller-shaft exposing groove 40 formed in the left developing-chamber side wall 56.

As shown in FIG. 2A, the gear train 63 includes a developing-roller coupling 68, a developing-roller gear 69, a supply-roller gear (not shown), and an agitator gear (not shown).

The developing-roller coupling 68 has a general cylindrical shape, extending in the left-right direction. The left-right dimension of the developing-roller coupling 68 is greater than the left-right distance from the left surface of the left developing-chamber side wall 56 to the left endface of the developing-roller shaft 45.

Gear teeth are formed along the right edge portion of the peripheral surface on the developing-roller coupling 68 and cover the entire circumference thereof. A coupling recessed part (not shown) is formed in the left endface of the developing-roller coupling 68. The coupling recessed part receives a distal end of a body-side coupling 100 provided inside the main casing 2 when the developing cartridge 25 is mounted in the main casing 2. The distal end of the body-side coupling 100 is inserted into the coupling recessed part so as to be incapable of rotating relative thereto.

By fitting the developing-roller coupling 68 around the outer side of the coupling support shaft 67, the developing-roller coupling 68 can be rotatably supported on the coupling support shaft 67.

The developing-roller gear 69 is mounted on the left end of the developing-roller shaft 45 and is incapable of rotating relative to the developing-roller shaft 45. Gear teeth on the developing-roller gear 69 engage with gear teeth on the developing-roller coupling 68 from the right side thereof.

The supply-roller gear (not shown) is mounted on the left end of the supply-roller shaft 47 and is incapable of rotating relative to the supply-roller shaft 47. Gear teeth on the supply-roller gear engage with gear teeth on the developing-roller coupling 68 from a position diagonally below and rearward of the developing-roller coupling 68 (see FIG. 2B).

The agitator gear (not shown) is mounted on the left end of the agitator shaft 51 and is incapable of rotating relative to the agitator shaft 51. The agitator gear is coupled to the developing-roller coupling 68 via an idle gear (not shown) for transmitting a drive force from the developing-roller coupling 68 (see FIG. 2B).

The drive-side gear cover 64 has a box-like shape and is elongated in the left-right direction and closed on the left end. The drive-side gear cover 64 is formed of sufficient size (front-rear, vertical, and left-right dimensions) to cover the entire gear train 63. The drive-side gear cover 64 is mounted on the left surface of the left side wall 35 so as to cover the entire gear train 63 (excluding the coupling recessed part in the developing-roller coupling 68) from a left side perspective. With this configuration, the left side of the drive unit 60 (drive-side gear cover 64) is positioned farther leftward (outside in the axial direction) than the left endface of the developing-roller shaft 45. Note that both the drive-side gear cover 64 and bearing member 62 are integrally fixed with screws to the left side wall 35 (the left developing-chamber side wall 56).

(1-4) Drive Operations for Rotating the Various Rollers

As illustrated in FIGS. 2A and 2B, the distal end of the body-side coupling 100 disposed inside the main casing 2 becomes inserted into the coupling recessed part of the developing-roller coupling 68 when the developing cartridge 25 is mounted in the main casing 2. The distal end of the body-side coupling 100 is inserted in such a way as to be incapable of rotating relative to the developing-roller coupling 68 and, hence, the body-side coupling 100 functions to input a drive force from the main casing 2 into the developing-roller coupling 68.

The drive force inputted into the developing-roller coupling 68 is transmitted to the developing roller 16 via the developing-roller gear 69. The drive force drives the developing roller 16 to rotate relative to the cartridge frame 30 in a rotating direction X indicated by an arrow in FIG. 2B (counterclockwise in a left side view) about an axis A.

The drive force inputted into the developing-roller coupling 68 is also transmitted to the supply roller 27 via the supply-roller gear (not shown) and to the agitator 34 via the agitator gear (not shown) and an idle gear (not shown). As shown in FIG. 2B, the supply roller 27 is driven to rotate in a rotating direction Y indicated by an arrow (counterclockwise in a left side view) such that the portion of the supply roller 27 opposing and contacting the developing roller 16 moves in the direction opposite the developing roller 16. The agitator 34 is also driven to rotate in a rotating direction Z indicated by an arrow (clockwise in a left side view).

(1-5) Power-Supply Unit

As shown in FIG. 2A, the power supply unit 61 is provided on the right surface of the right side wall 35. The power supply unit 61 includes an electrode member 70, and a supply-side gear cover 72.

As shown in FIG. 3A, the electrode member 70 has a generally flat plate shape and is substantially rectangular in a side view. The electrode member 70 is formed of an electrically conductive resin material such as a conductive POM. The electrode member 70 is integrally provided with a developing-roller-shaft support hole 80, a developing-roller-shaft collar 73, the supply-roller-shaft support hole 74, and a power-supply part 75.

The developing-roller-shaft support hole 80 has a general circular shape in a side view and penetrates an upper portion of the electrode member 70 near the rear edge thereof. The inner diameter of the developing-roller-shaft support hole 80 is approximately equal to (slightly greater than) the outer diameter of the developing-roller shaft 45.

The developing-roller-shaft collar 73 has a general cylindrical shape and protrudes rightward from the peripheral edge of the developing-roller-shaft support hole 80.

The supply-roller-shaft support hole 74 has a general circular shape in a side view and penetrates the electrode member 70 at a position diagonally downward and forward of the developing-roller-shaft support hole 80. The inner diameter of the supply-roller-shaft support hole 74 is approximately equal to (slightly larger than) the outer diameter of the supply-roller shaft 47.

The power-supply part 75 has a general cylindrical shape and protrudes rightward from the right surface of the electrode member 70 at a position forward of the developing-roller-shaft support hole 80. The left-right dimension of the power-supply part 75 is greater than the left-right distance from the right developing-chamber side wall 55 to the right endface of the developing-roller shaft 45.

The electrode member 70 is mounted on the right surface of the right developing-chamber side wall 55 such that the right end of the developing-roller shaft 45 is inserted through the developing-roller-shaft support hole 80 and the right end of the supply-roller shaft 47 is inserted through the supply-roller-shaft support hole 74. In this state, the right end of the developing-roller shaft 45 is rotatably supported in the developing-roller-shaft support hole 80 and is covered around its circumference by the developing-roller-shaft collar 73.

As shown in FIG. 2A, the supply-side gear cover 72 has a box-like shape that is elongated in the left-right direction and closed on the right end. The supply-side gear cover 72 has a size (front-rear, vertical, and left-right dimensions) sufficient for covering the front portion of the electrode member 70 (the power-supply part 75).

A power-supply-part exposing hole 76 is formed in the supply-side gear cover 72. The power-supply-part exposing hole 76 is generally rectangular in a plan view and penetrates an approximate front-rear central region in the top wall of the supply-side gear cover 72. The power-supply part 75 of the electrode member 70 is exposed above the supply-side gear cover 72 through the power-supply-part exposing hole 76.

The supply-side gear cover 72 is mounted on the right surface of the right side wall 35 so as to cover the front portion of the electrode member 70 (the power-supply part 75) from the right. In this state, the right end of the power supply unit 61 (the supply-side gear cover 72) is positioned farther rightward (further outside in the axial direction) than the right endface of the developing-roller-shaft collar 73, as illustrated in FIG. 4A. In other words, the right end of the power supply unit 61 (the supply-side gear cover 72) is disposed farther rightward (further outside in the axial direction) than the right end of the developing-roller shaft 45 covered by the developing-roller-shaft collar 73 (see FIG. 2A). The supply-side gear cover 72 and electrode member 70 are integrally fixed by screws to the right side wall 35 (the right developing-chamber side wall 55).

(1-6) Operations for Supplying Electricity to the Various Rollers

As shown in FIG. 2A, a body-side electrode 101 disposed inside the main casing 2 contacts the power-supply part 75 through the power-supply-part exposing hole 76 when the developing cartridge 25 is mounted in the main casing 2. With this construction, the body-side electrode 101 supplies power to the electrode member 70 and, via the electrode member 70, applies a bias to the developing roller 16 and supply roller 27.

3. Impact Reduction Effect of the Developer Cartridge

Next, the impact reduction effect of the developing cartridge 25 when the developing cartridge 25 is dropped on a floor F or the like will be described.

Figure 4C:
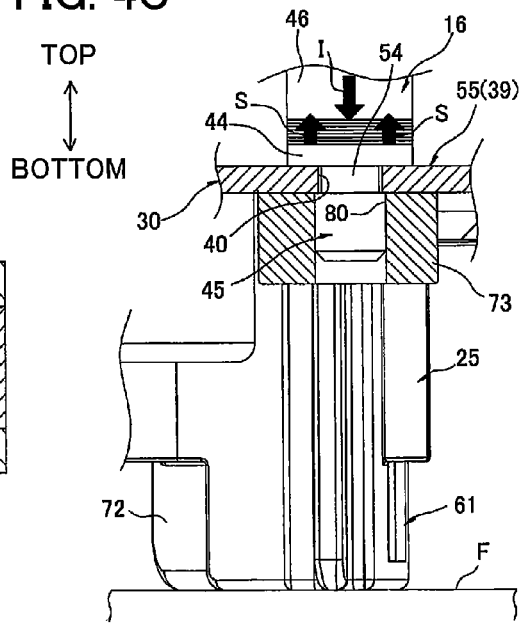
FIG. 4C is a view illustrating how impacts are exerted on the developing cartridge of FIG. 2A when the developing cartridge is dropped onto a floor.

It is possible that the user may inadvertently drop the developing cartridge 25 when mounting the developing cartridge 25 in or removing the developing cartridge 25 from the printer 1. It is also possible that the right end of the power supply unit 61 could collide with the floor F if the developing cartridge 25 falls with the axis of the developing roller 16 oriented vertically, as illustrated in FIG. 4C. In this case, a downward inertial force I is produced in the developing roller 16. However, the contact member 44 is interposed between the rubber roller 46 of the developing roller 16 and right developing-chamber side wall 55 and contacts both components, thereby suppressing downward movement of the developing roller 16. Further, since the contact member 44 is in contact with the rubber roller 46, the inertial force I generated in the developing roller 16 first acts on the contact member 44. At this time, stress S is generated in the contact member 44 in response to the applied inertial force I (load), and the stress S acts on the rubber roller 46. Thus, the rubber roller 46 is elastically deformed by the stress S generated in the contact member 44. The elastic deformation of the rubber roller 46 absorbs the downward (outward in the axial direction) inertial force I produced in the developing roller 16.

4. Operational Advantages (1) As shown in FIG. 4B, the contact member 44 is disposed in the developing cartridge 25 between the right endface of the rubber roller 46 and the left surface of the developing-chamber side wall 39 and contacts both the rubber roller 46 and developing-chamber side wall 39. Therefore, even if the developing cartridge 25 is dropped such that the right end of the power supply unit 61 disposed on the cartridge frame 30 strikes the floor F as illustrated in FIG. 4C, the contact member 44 can restrain the developing roller 16 from moving downward relative to the cartridge frame 30.

Thus, although the inertial force I in the downward direction is produced in the developing roller 16 as the developing cartridge 25 falls, this construction can reduce the degree to which the inertial force I acts on the right developing-chamber side wall 55 of the cartridge frame 30, thereby reducing the likelihood of damage to the right developing-chamber side wall 55. Consequently, it is less likely that the developing roller 16 will come out of the cartridge frame 30 allowing toner to leak out of the cartridge frame 30.

Therefore, even if the developing cartridge 25 is inadvertently dropped, the configuration described above reduces the likelihood that the cartridge frame 30 (and specifically the right developing-chamber side wall 55) will be broken, thereby reducing the likelihood that toner will spill out of the cartridge frame 30.

The rubber roller 46 shown in FIG. 4C is a flexible member formed of silicone rubber. When the developing cartridge 25 is dropped, the downward inertial force I (load) produced in the developing roller 16 is first applied to the contact member 44 since the rubber roller 46 is in contact with the contact member 44. Stress S is produced in the contact member 44 in response to the inertial force I, and this stress S is applied to the rubber roller 46.

However, since the rubber roller 46 is formed of silicone rubber, the stress S applied by the contact member 44 elastically deforms the rubber roller 46. This elastic deformation absorbs the downward inertial force I generated in the developing roller 16. Therefore, this configuration can limit the amount of load that is applied to the right developing-chamber side wall 55 since the downward inertial force I generated in the developing roller 16 is applied to the right developing-chamber side wall 55 through the contact member 44, reliably reducing the potential for damage to the right developing-chamber side wall 55.

(2) As shown in FIG. 3A, the cartridge frame 30 includes the electrode member 70 for supporting the right end of the developing-roller shaft 45. The electrode member 70 is formed of an electrically conductive resin, such as a POM resin. Accordingly, when the developing cartridge 25 is mounted in the main casing 2 and the body-side electrode 101 contacts the power-supply part 75 of the electrode member 70 through the power-supply-part exposing hole 76 as illustrated in FIG. 2A, the body-side electrode 101 supplies power to the developing roller 16 and the supply roller 27 via the electrode member 70 (see FIG. 2B). Accordingly, the above structure enables a bias to be applied to the developing roller 16 and the supply roller 27 (see FIG. 2B).

An electrically conductive resin is more fragile than an insulating resin. However, with the structure of the developing cartridge 25 shown in FIG. 4C, the developing roller 16 is restrained from moving outward in the axial direction relative to the cartridge frame 30. Accordingly, damage to the electrode member 70 is unlikely, even when the electrode member 70 is formed of a relatively fragile electrically conductive resin.

5. Second Embodiment

A contact member 244 according to a second embodiment of the present embodiment will be described next with respect to FIGS. 5A to 5C.

Figure 5A:
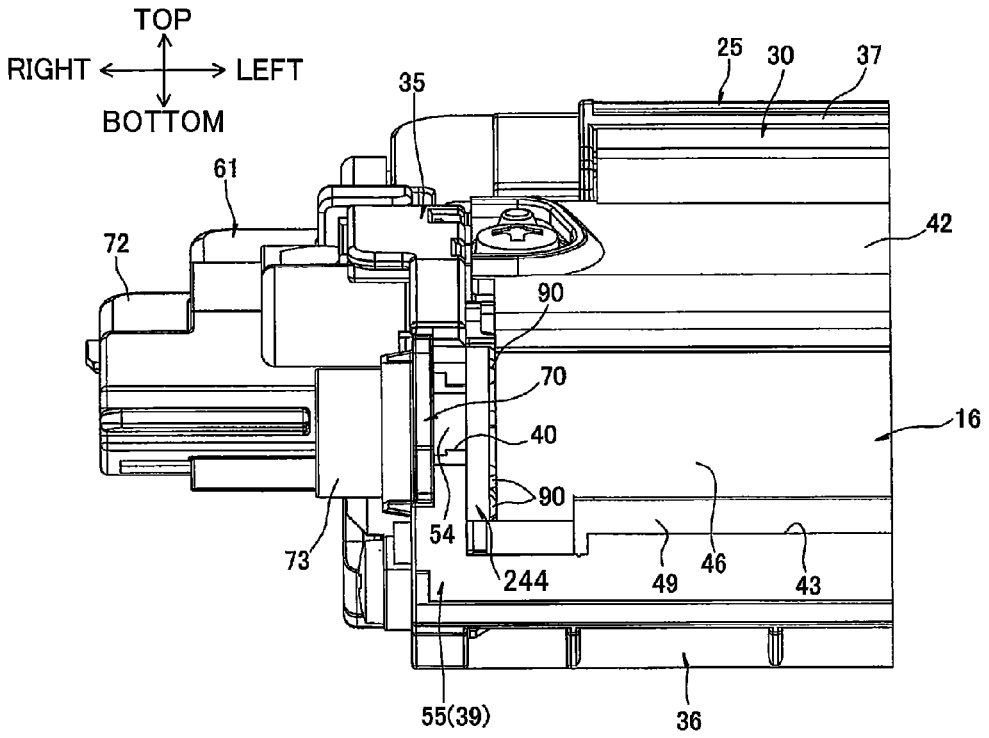
FIG. 5A is a rear view of a right end portion of a developing cartridge according to a second embodiment of the present invention, the developing cartridge including the developing roller and a contact member according to the second embodiment.
Figure 5B:
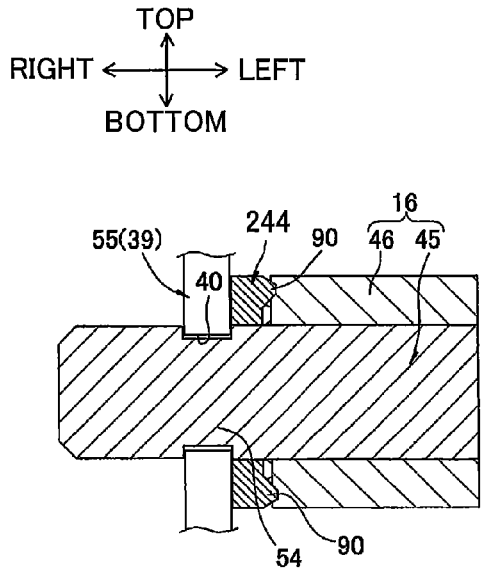
FIG. 5B is a cross-sectional view of the developing roller and the contact member shown in FIG. 5A.
Figure 5C:
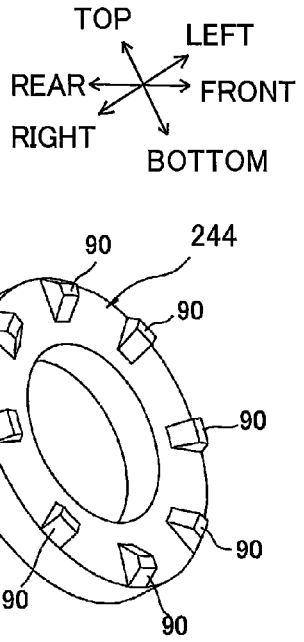
FIG. 5C is a perspective view of the contact member of FIG. 5A as viewed from its lower left side.

In FIGS. 5A to 5C, like parts and components corresponding to those in FIGS. 1 to 4C are designated with the same reference numbers to avoid duplicating explanation.

The contact member 244 of the second embodiment has a left endface on which eight protrusions 90 are integrally provided, as illustrated in FIG. 5C. The protrusions 90 are provided along an outer edge of the left endface and are spaced at intervals of approximately 45 degrees in a circumferential direction.

When viewed along the circumferential direction of the contact member 244, each protrusion 90 is generally triangular in shape and protrudes leftward from the left endface of the contact member 244. The protrusions 90 are formed with a substantial thickness in the circumferential direction. Hence, the protrusions 90 protrude leftward (in the axial direction) toward the right endface of the rubber roller 46, as shown in FIG. 5B.

With this construction, the contact member 244 is disposed between the right endface of the rubber roller 46 and the left surface of the right developing-chamber side wall 55 with the protrusions 90 contacting the right endface of the rubber roller 46. Consequently, a slight gap is formed between the left endface of the contact member 244 and the right endface of the rubber roller 46 in the left-right direction. This construction reduces the area of contact between the right endface of the rubber roller 46 and the contact member 244 compared to the structure shown in FIG. 4B in which the entire right endface of the rubber roller 46 contacts the entire left endface of the contact member 44.

As a result, when the developing cartridge 25 is dropped and a downward inertial force I is generated in the developing roller 16, the stress S of the contact member 244 acting on the rubber roller 46 is concentrated in smaller areas (pressure per unit area is increased), when compared to the contact member 44 of the first embodiment. Since the stress S generated in the contact member 244 is reliably applied to the rubber roller 46 in this way, this configuration can reliably suppress the amount of downward inertial force I applied to the right developing-chamber side wall 55 through the contact member 244.

The contact member 244 also rotates integrally with the developing roller 16 in accordance with the rotation of the developing roller 16, as in the first embodiment.

In the second embodiment illustrated in FIG. 5B, the contact member 244 is arranged such that the protrusions 90 contact the right endface of the rubber roller 46, but the contact member 244 may be arranged instead such that the protrusions 90 contact the left surface of the right developing-chamber side wall 55. Placing the protrusions 90 in contact with the left surface of the right developing-chamber side wall 55 reduces the amount of area of contact between the contact member 244 and right developing-chamber side wall 55 in comparison to the structure described in the first embodiment in which the entire right endface of the contact member 44 contacts the left surface of the right developing-chamber side wall 55.

The latter configuration can reduce a frictional resistance between the contact member 244 and right developing-chamber side wall 55 when the developing roller 16 is driven to rotate, ensuring that the developing roller 16 can rotate smoothly.

Note that the protrusions 90 may be provided on both left and right endfaces of the contact member 244. Still alternatively, the protrusions 90 may be provided on the right endface of the rubber roller 46, instead of on the left endface of the contact member 244.

6. Third Embodiment

A contact member 344 according to a third embodiment of the present embodiment will be described next with respect to FIGS. 6A to 6C.

Figure 6A:
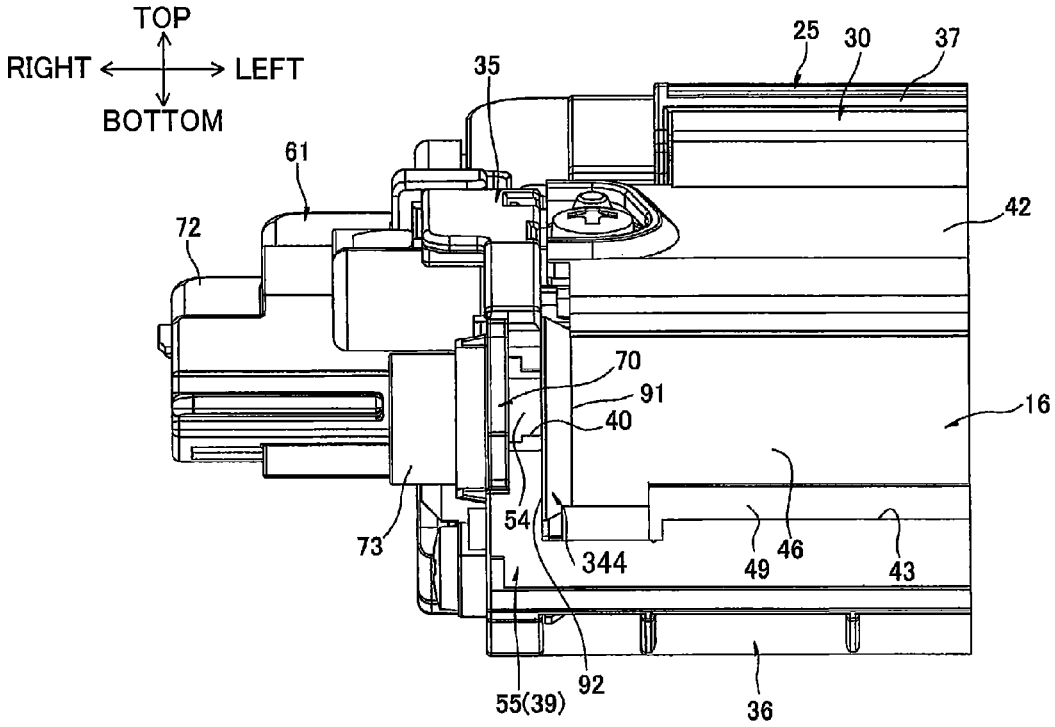
FIG. 6A is a rear view of a right end portion of a developing cartridge according to a third embodiment of the present invention, the developing cartridge including the developing roller and a contact member according to the third embodiment.
Figure 6B:
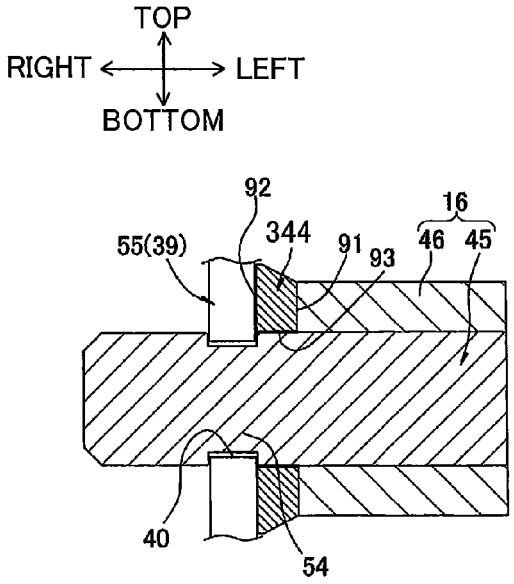
FIG. 6B is a cross-sectional view of the developing roller and the contact member shown in FIG. 6A.
Figure 6C:
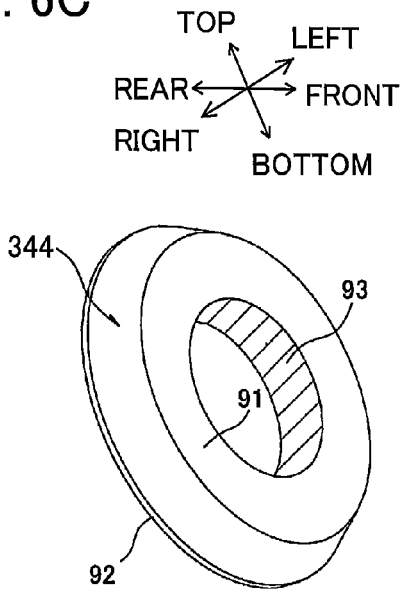
FIG. 6C is a perspective view of the contact member of FIG. 6A as viewed from its lower left side.

In FIGS. 6A to 6C, like parts and components corresponding to those in FIGS. 1 to 4C are designated with the same reference numbers to avoid duplicating explanation.

In the third embodiment of the present invention, the contact member 344 is formed of a rubber material, and specifically silicone rubber. As shown in FIG. 6C, the contact member 344 has a general cylindrical shape but tapers in diameter toward the left side. More specifically, the contact member 344 has a right endface 92, and a left endface 91. The right endface 92 of the contact member 344 has a larger surface area than the left endface 91.

As shown in FIG. 6B, the contact member 344 is disposed between the rubber roller 46 and the right developing-chamber side wall 55, with the left endface 91 of the contact member 344 contacting the right endface of the rubber roller 46 and the right endface 92 contacting the left surface of the right developing-chamber side wall 55. Grease 93 is applied to an inner circumferential surface of the contact member 344 to reduce friction between the contact member 344 and the outer circumferential surface of the developing-roller shaft 45.

Since the contact member 344 is formed of silicone rubber in the third embodiment, the contact member 344 elastically deforms when the downward inertial force I (see FIG. 4C) produced in the developing roller 16 as the developing cartridge 25 falls is applied to the contact member 344. Consequently, the inertial force I is absorbed through the elastic deformation of the contact member 344, thereby reducing the amount of inertial force I that is applied to the right developing-chamber side wall 55 through the contact member 344 and reliably reducing the likelihood that the right developing-chamber side wall 55 will be damaged.

Since the right endface 92 of the contact member 344 has a relatively large surface area, placing the right endface 92 in contact with the left surface of the right developing-chamber side wall 55 helps to reduce a contact pressure on the right developing-chamber side wall 55 (load per unit area) when the inertial force I is applied to the right developing-chamber side wall 55 through the contact member 344. Accordingly, this configuration more reliably reduces the likelihood of damage occurring to the right developing-chamber side wall 55.

Due to contact of the contact member 344 made of silicone rubber and the right endface of the rubber roller 46, the contact member 344 is caused to rotate together with the developing roller 16 when the developing roller 16 is driven to rotate.

Further, since the contact member 344 can elastically deform, this configuration eliminates the need to allocate a sufficient space in the axial direction for providing the contact member 344 between the rubber roller 46 and the right developing-chamber side wall 55. Hence, the developing cartridge 25 can be made more compact in the axial direction.

7. Fourth Embodiment

A contact member 444 according to a fourth embodiment of the present embodiment will be described next with respect to FIGS. 7A to 7C.

Figure 7A:
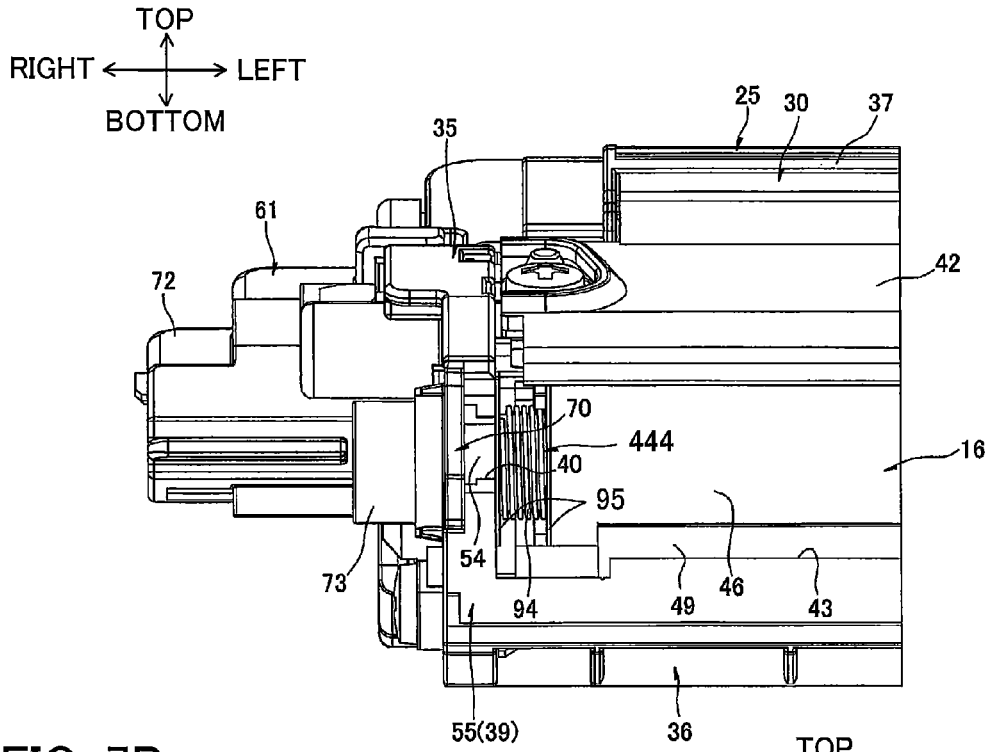
FIG. 7A is a rear view of a right end portion of a developing cartridge according to a fourth embodiment of the present invention, the developing cartridge including the developing roller and a contact member according to the fourth embodiment.
Figure 7B:
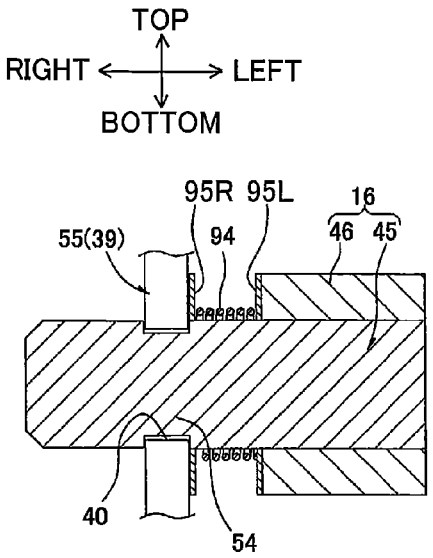
FIG. 7B is a cross-sectional view of the developing roller and the contact member shown in FIG. 7A.
Figure 7C:
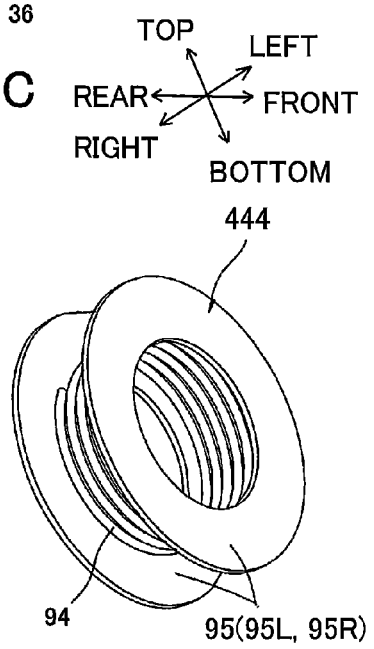
FIG. 7C is a perspective view of the contact member of FIG. 7A as viewed from its lower left side.

In FIGS. 7A to 7C, like parts and components corresponding to those in FIGS. 1 to 4C are designated with the same reference numbers to avoid duplicating explanation.

In the fourth embodiment of the present invention shown in FIG. 7C, the contact member 444 includes a coil spring 94, and a pair of pads 95.

As shown in FIG. 7A, the coil spring 94 has a shape of an air-core coil that extends in the left-right direction. The coil spring 94 has an inner diameter that is approximately equal to (slightly larger than) the outer diameter of the developing-roller shaft 45.

Each of the pads 95 is formed of a metal material and has a general shape of an annular disk. The pads 95 are formed with an outer diameter approximately equal to the outer diameter of the rubber roller 46 and an inner diameter approximately equal to (slightly larger than) the outer diameter of the developing-roller shaft 45. The pads 95 are disposed on left and right ends of the coil spring 94 such that their centers are aligned with the axis of the coil spring 94 in the left-right direction. Each pad 95 is disposed to be in contact with each end of the coil spring 94.

As shown in FIG. 7B, the contact member 444 is disposed between the rubber roller 46 and the right developing-chamber side wall 55, with the left surface of the left pad 95 contacting the right endface of the rubber roller 46 and the right surface of the right pad 95 contacting the left surface of the right developing-chamber side wall 55.

When the developing roller 16 rotates, the pad 95 on the left side (pad 95L in FIGS. 7B and 7C) also rotates together with the developing roller 16. However, the pad 95 on the right side (pad 95R in FIGS. 7B and 7C) and the coil spring 94 do not rotate in conjunction with rotation of the developing roller 16. That is, the pad 95L rotates relative to the coil spring 94 but the pad 95R remains still relative to the coil spring 94 and the right developing-chamber side wall 55 when the developing roller 16 rotates.

The pad 95R is restricted from rotating relative to the cartridge frame 30 (the right developing-chamber side wall 55) by friction between the left surface of the right developing-chamber side wall 55 and a right endface of the pad 95R. Accordingly, this simple configuration can restrain the pad 95R and the coil spring 94 from rotating along with the rotation of the developing roller 16 when the developing roller 16 is driven to rotate.

Since the contact member 444 is provided with the coil spring 94 in the fourth embodiment, the coil spring 94 can deform elastically when the downward (outward in the axial direction) inertial force I (see FIG. 4C) generated in the developing roller 16 acts on the contact member 444. Accordingly, the elastic deformation of the coil spring 94 absorbs the inertial force I. Hence, by reducing the amount of inertial force I applied to the right developing-chamber side wall 55 through the contact member 444, the structure of the fourth embodiment reliably suppresses (mitigates) damage to the right developing-chamber side wall 55.

8. Fifth Embodiment

A contact member 544 according to a fifth embodiment of the present embodiment will be described next with respect to FIGS. 8A to 8C.

Figure 8A:
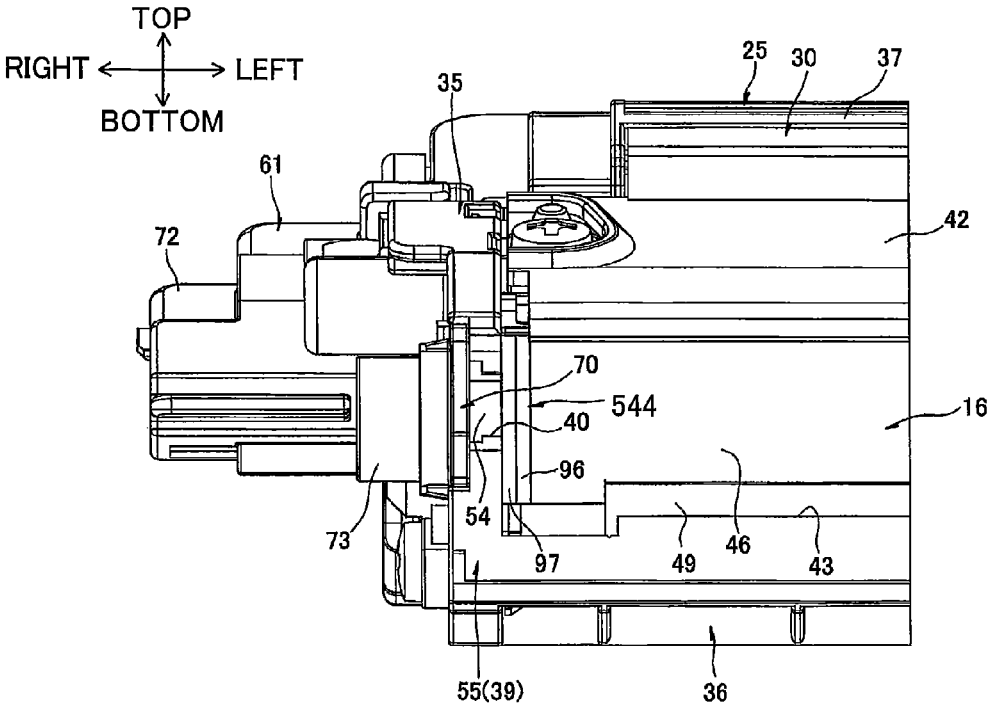
FIG. 8A is a rear view of a right end portion of a developing cartridge according to a fifth embodiment of the present invention, the developing cartridge including the developing roller and a contact member according to the fifth embodiment.
Figure 8B:
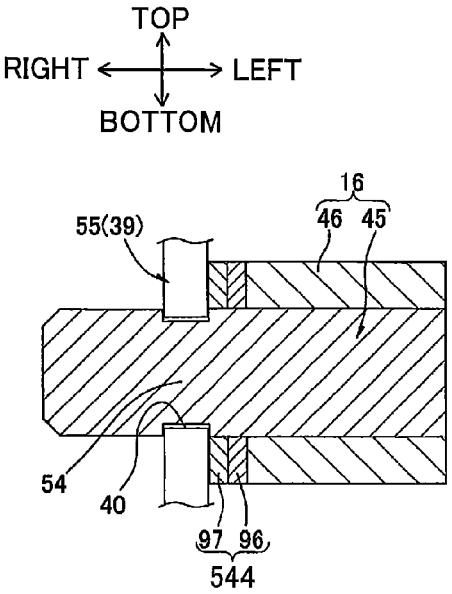
FIG. 8B is a cross-sectional view of the developing roller and the contact member shown in FIG. 8A.
Figure 8C:
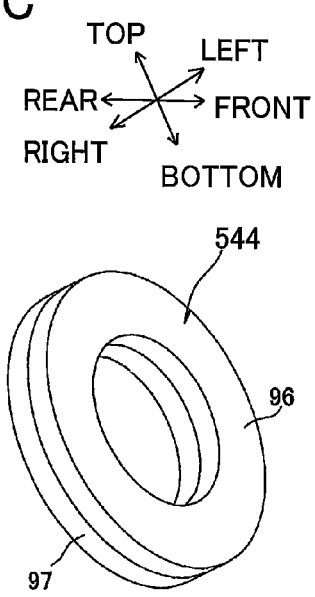
FIG. 8C is a perspective view of the contact member of FIG. 8A as viewed from its lower left side.

In FIGS. 8A to 8C, like parts and components corresponding to those in FIGS. 1 to 4C are designated with the same reference numbers to avoid duplicating explanation.

In the fifth embodiment of the present invention, the contact member 44 is configured of two members. As shown in FIG. 8C, the contact member 544 includes a first contact member 96, and a second contact member 97.

The first and second contact members 96 and 97 are each formed of POM resin. The first and second contact members 96 and 97 are generally cylindrical in shape and elongated in the left-right direction. Each of the first and second contact members 96 and 97 is formed with an outer diameter approximately equal to the outer diameter of the rubber roller 46 and an inner diameter approximately equal to (slightly larger than) the outer diameter of the developing-roller shaft 45. The first and second contact members 96 and 97 are disposed adjacent to each other in the left-right direction with their axes aligned. That is, the right endface of the first contact member 96 contacts the left endface of the second contact member 97, as illustrated in FIG. 8B.

The contact member 544 is disposed between the rubber roller 46 and right developing-chamber side wall 55 such that the left endface of the first contact member 96 contacts the right endface of the rubber roller 46 and the right endface of the second contact member 97 contacts the left surface of the right developing-chamber side wall 55.

When the developing roller 16 rotates, only the first contact member 96 rotates together with the rubber roller 46 while the second contact member 97 does not rotate relative to the rubber roller 46. That is, the right endface of the first contact member 96 slidingly moves relative to the left endface of the second contact member 97, when the developing roller 16 rotates. The second contact member 97 is restricted from rotating relative to the right developing-chamber side wall 55 when the developing roller 16 rotates, due to friction generated between the right endface of the second contact member 97 and the left surface of the right developing-chamber side wall 55.

By configuring the contact member 544 of the first contact member 96 and second contact member 97 in the fifth embodiment, each component can be formed of a suitable material. Specifically, each of the first and second contact members 96 and 97 can be formed of POM resin to reduce a frictional resistance therebetween during rotation of the developing roller 16, ensuring that the developing roller 16 can rotate smoothly (see FIG. 2B).

In case of the contact member 44 of the first embodiment, the right endface of the contact member 44 slidingly moves relative to the left surface of the right developing-chamber side wall 55 when the developing roller 16 rotates. Since the right developing-chamber side wall 55 and the contact member 44 are formed of materials different from each other, a frictional resistance therebetween is inherently larger than the frictional resistance between the first contact member 96 and second contact member 97 both formed of the same material (POM resin) in the fifth embodiment. Hence, this construction of the fifth embodiment can ensure smoother rotation of the developing roller 16, in comparison with the structure of the first embodiment.

9. Sixth Embodiment

A contact member 644 according to a sixth embodiment of the present embodiment will be described next with respect to FIGS. 9A to 9C.

Figure 9A:
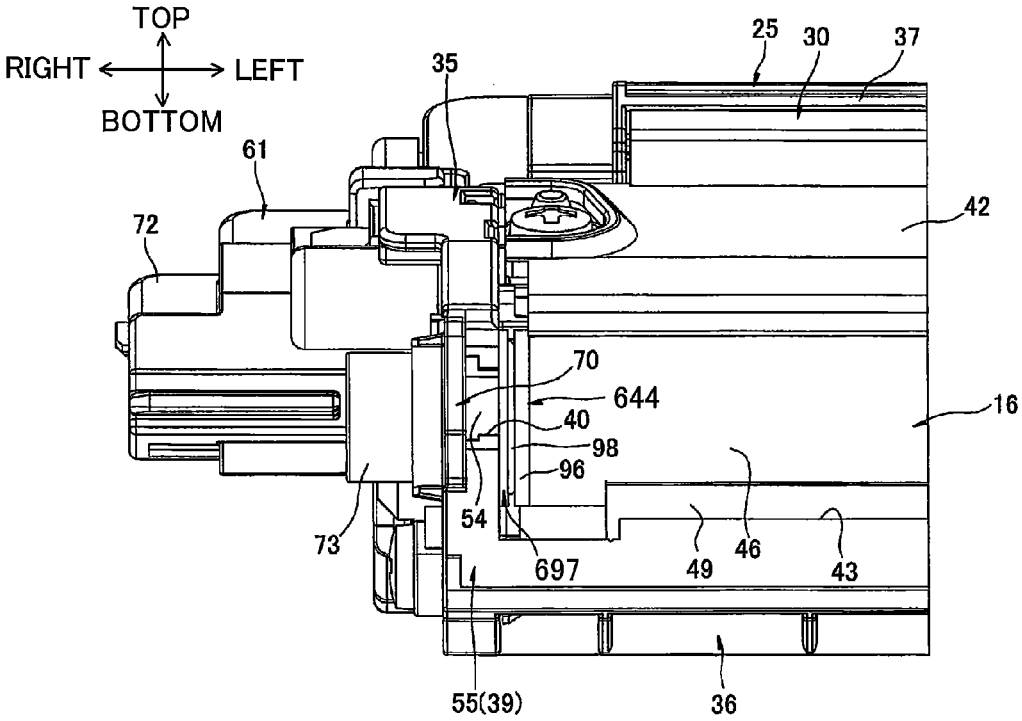
FIG. 9A is a rear view of a right end portion of a developing cartridge according to a sixth embodiment of the present invention, the developing cartridge including the developing roller and a contact member according to the sixth embodiment.
Figure 9B:
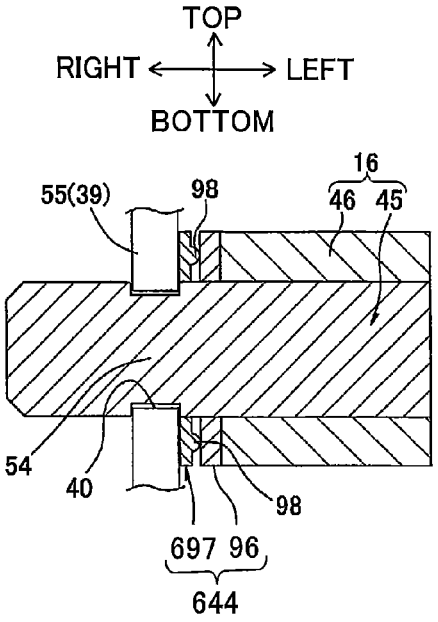
FIG. 9B is a cross-sectional view of the developing roller and the contact member shown in FIG. 9A.
Figure 9C:
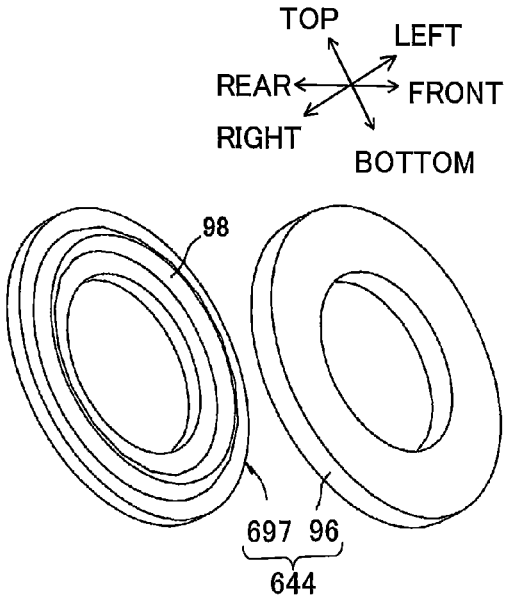
FIG. 9C is a perspective view of the contact member of FIG. 9A as viewed from its lower left side.

In FIGS. 9A to 9C, like parts and components corresponding to those in FIGS. 1 to 4C and 8A to 8C are designated with the same reference numbers to avoid duplicating explanation.

In the sixth embodiment, the contact member 644 is configured of the first contact member 96 of the fifth embodiment and a second contact member 697 similar to the second contact member 97 of the fifth embodiment. Specifically, as illustrated in FIG. 9C, the second contact member 697 of the sixth embodiment has a left endface on which a ridge 98 is integrally formed on.

The ridge 98 is circular in a left side view and positioned on the left endface of the second contact member 697 in approximately a radial center thereof. As shown in FIGS. 9B and 9C, the ridge 98 protrudes leftward from the left surface of the second contact member 97 and has a semicircular cross section. Thus, the ridge 98 protrudes leftward (in the axial direction) toward the first contact member 96.

The first and second contact members 96 and 697 are disposed adjacent to each other in the left-right direction with their axes aligned. Consequently, the distal end (left end) of the ridge 98 contacts the right endface of the first contact member 96 so that the right endface of the first contact member 96 is slightly separated from the left endface of the second contact member 697 in the left-right direction.

As in the fifth embodiment, when the developing roller 16 rotates, only the first contact member 96 rotates together with the developing roller 16. That is, the first contact member 96 rotates relative to the second contact member 697 such that the right endface of the first contact member 96 slidingly moves relative to the distal end of the ridge 98. Hence, as in the fifth embodiment, when the developing roller 16 rotates, the second contact member 697 is restricted from rotating relative to the right developing-chamber side wall 55 due to frictional force generated between the right endface of the second contact member 697 and the left surface of the right developing-chamber side wall 55.

Thus, the configuration according to the sixth embodiment can reduce the area of contact between the first and second contact members 96 and 697, thereby reducing a frictional resistance between the first and second contact members 96 and 697 when the developing roller 16 is driven to rotate (see FIG. 2B) and ensuring that the developing roller 16 rotates more smoothly.

The ridge 98 may be formed on the right endface of the first contact member 96, instead of on the left endface of the second contact member 697.

10. Seventh Embodiment

A contact member 744 according to a seventh embodiment of the present embodiment will be described next with respect to FIGS. 10A and 10B.

Figures 10A, 10B:
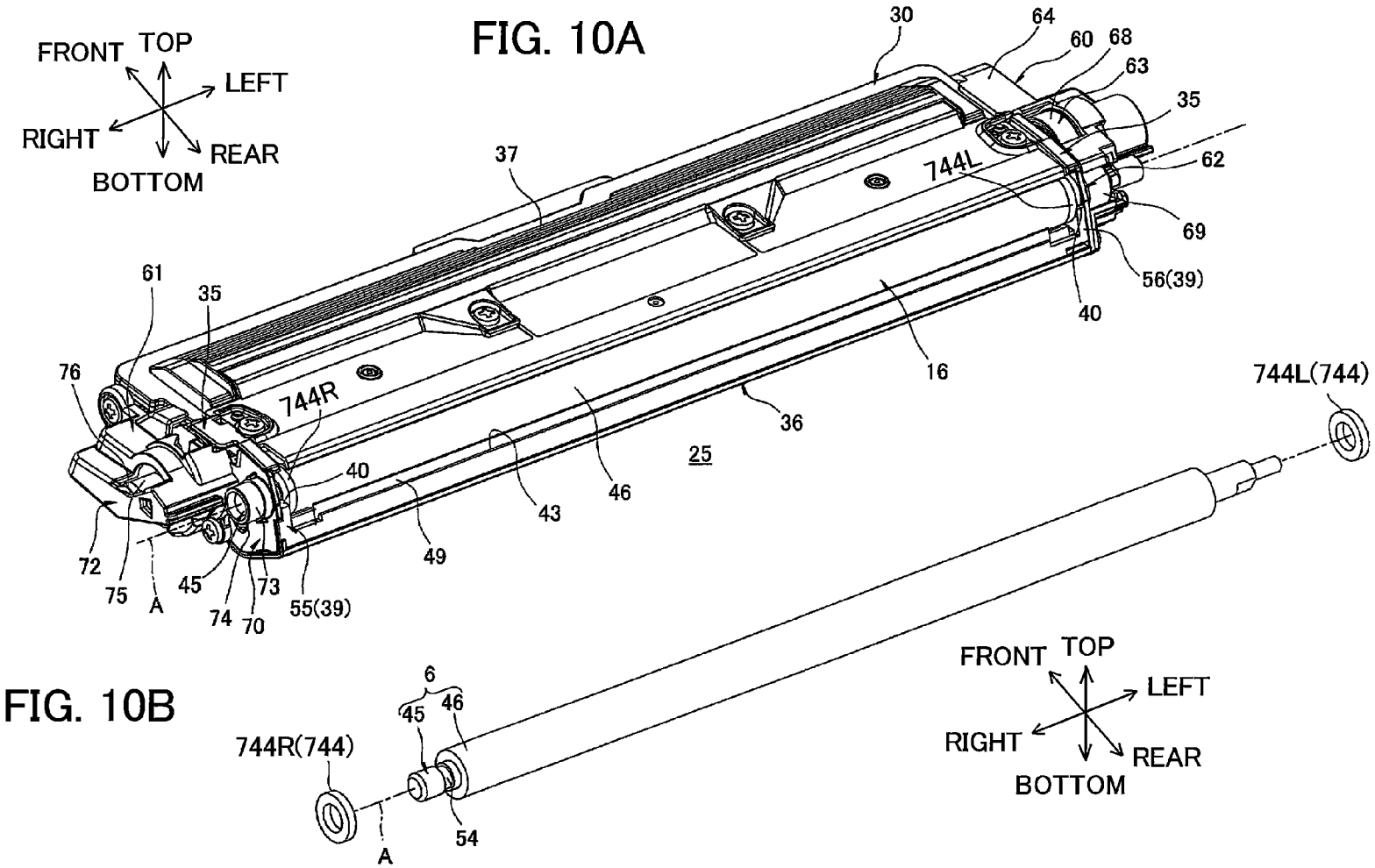
FIG. 10A is an exploded perspective view of a developing cartridge according to a seventh embodiment of the present invention as viewed from its upper-right side, the developing cartridge including the developing roller and a pair of contact members according to the seventh embodiment.
FIG. 10B is an exploded perspective view of the developing roller and the pair of contact members shown in FIG. 10A.

In FIGS. 10A and 10B, like parts and components corresponding to those in FIGS. 1 to 4C are designated with the same reference numbers to avoid duplicating explanation.

In the first through sixth embodiments described above, the contact member 44 (244, 344, 444, 544, 644) is provided only on the right side of the developing roller 16 against the right endface of the rubber roller 46. However, in the seventh embodiment illustrated in FIGS. 10A and 10B, contact members 744 are provided on both left and right ends of the developing roller 16 against both left and right endfaces of the rubber roller 46.

Specifically, the contact member 744 on the right end of the developing roller 16 (hereinafter referred to as the right contact member 744R) is positioned between the right endface of the rubber roller 46 and the left surface (inner surface in the axial direction) of the right developing-chamber side wall 55, as illustrated in FIG. 10A. That is, the right contact member 744R has a left endface (inside surface in the axial direction) that contacts the right endface of the rubber roller 46, and a right endface (outside surface in the axial direction) that contacts the left surface of the right developing-chamber side wall 55.

Similarly, the contact member 744 on the left end of the developing roller 16 (hereinafter referred to as the left contact member 744L) is positioned between the left endface (other axial end) of the rubber roller 46 and the right surface (inner surface in the axial direction) of the left developing-chamber side wall 56 and the right endface of the developing-roller-shaft support part 65 constituting the bearing member 62 (see FIG. 3A). That is, the left contact member 744L has a right endface (inside surface in the axial direction) that contacts the left endface of the rubber roller 46, and a left endface (outside surface in the axial direction) that contacts the right surface of the left developing-chamber side wall 56 and the right endface of the developing-roller-shaft support part 65.

Hence, the right contact member 744R and left contact member 744L are disposed between respective axial ends of the rubber roller 46 and the corresponding right developing-chamber side wall 55 and left developing-chamber side wall 56. Accordingly, if the developing cartridge 25 is dropped as illustrated in FIG. 4C so that either left or right end of the cartridge frame 30, and specifically either the right end of the power supply unit 61 or the left end of the drive unit 60, impacts the floor F or the like, the above structure of the seventh embodiment can reliably restrain downward (outward in the axial direction) movement of the developing roller 16 relative to the cartridge frame 30.

11. Variations and Modifications

The above described configurations of the developing roller 16 provided with the contact members 44 (244, 344, 444, 544, 644, 744) may also be applied to another rotary body, such as a supply roller 27, or a charging roller.

If the supply roller 27 is treated as the rotary body in place of the developing roller 16, the supply-roller shaft 47 of the supply roller 27 corresponds to the shaft part and the sponge roller 48 corresponds to the cover part (see FIG. 2B). In this case, the contact member 44 (244, 344, 444, 544, 644, 744R) can be positioned between the right endface of the sponge roller 48 and the left surface of the electrode member 70 so as to contact both surfaces.

This configuration can restrain the supply roller 27 from moving downward (outward in the axial direction) relative to the cartridge frame 30, even if the developing cartridge 25 is dropped such that the right end of the power supply unit 61 constituting the developing cartridge 25 collides with the floor F or the like, as illustrated in FIG. 4C. The contact member 44 (244, 344, 444, 544, 644, 744L) may also be positioned between the left endface of the sponge roller 48 (see FIG. 2B) and the right endface of the supply-roller-shaft support part 66 constituting the bearing member 62 (see FIG. 3A) so as to contact both endfaces.

The developing cartridge 25 described above are merely an example of a cartridge of the present invention. Also, the printer 1 in which the developing cartridge 25 is mountable is merely an example of an image forming apparatus of the present invention. The present invention is not limited to the configurations described above.

In addition to the direct tandem-type color printer 1 described in the embodiments, the image forming apparatus of the present invention may be configured as an intermediate transfer tandem-type color printer having a plurality of photosensitive bodies, an intermediate transfer body, and a transfer member.

Further, instead of the color printer 1 described in the embodiments, the image forming apparatus may be configured as a monochrome printer having a single process cartridge 11 for one color (black, for example). The image forming apparatus may also be provided with an image-reading unit and the like and configured as a multifunction peripheral.

It is also possible to provide the photosensitive drums 15 in the main casing 2 with only the developer cartridges 25 being detachably mounted in the main casing 2.

The developing cartridge 25 may also be configured of a toner cartridge accommodating toner, wherein the toner cartridge is detachably mounted on the cartridge frame retaining the developing roller 16.

Instead of the photosensitive drum 15, another photosensitive member such as a photosensitive belt can also be applied.

Corotron-type transfer members or the like may also be employed in place of the transfer rollers 20 described in the embodiments.

The scorotron charger 26 described in the embodiments may also be replaced with another noncontact charger, such as a corotron-type charger or a sawtooth-type discharge member, or a contact-type charger, such as a charging roller.

Further, conveying members, such as auger screws and conveying belts, may be used in place of the agitator 34 described in the embodiments.

With such modifications, similar operations and technical advantages with those of the first to seventh embodiments can be achieved. It should be noted that the above described first to seventh embodiments can be combined as appropriate.

While the invention has been described in detail with reference to the specific embodiment thereof, it would be apparent to those skilled in the art that various changes and modifications may be made therein without departing from the spirit of the invention.

What is claimed is:

1. A cartridge comprising:

a frame defining a chamber for storing developer therein;

a rotary body configured to be rotatably supported to the frame, wherein the rotary body comprises:

a metal shaft extending in an axial direction and having shaft end portions rotatably supported to the frame, the frame extending in the axial direction; and a cover portion made of an elastic material and provided around the metal shaft to expose the shaft end portions thereof, the cover portion having a first cover-portion end portion positioned inward of the frame in the axial direction; and a contact member provided on the metal shaft and disposed between the first cover-portion end portion and the frame in the axial direction such that the contact member is in contact with each of the first cover-portion end portion and the frame, wherein the frame further comprises a bearing member made of an electrically conductive resin and configured to rotatably support one of the shaft end portions of the metal shaft.

2. The cartridge according to claim 1, wherein one of the contact member and the first cover-portion end portion comprises an opposing portion opposing the other one of the contact member and the first cover-portion end portion in the axial direction, and a protrusion protruding from the opposing portion toward the other one of the contact member and the first cover-portion end portion.

3. The cartridge according to claim 2, wherein the protrusion has a protruding end configured to be in contact with the other one of the contact member and the first cover-portion end portion.

4. The cartridge according to claim 1, wherein the contact member is made of an elastic material.

5. The cartridge according to claim 1, wherein the frame comprises a first frame end portion positioned outward of the first cover-portion end portion in the axial direction, and wherein the contact member has a first surface configured to be in contact with the first cover-portion end portion and a second surface configured to be in contact with the first frame end portion, the second surface having a surface area larger than a surface area of the first surface.

6. The cartridge according to claim 1, wherein the contact member comprises a biasing portion configured to apply a biasing force acting in the axial direction to the first cover-portion end portion and the frame.

7. The cartridge according to claim 6, wherein the biasing portion comprises a coil spring.

8. The cartridge according to claim 6, wherein the frame comprises a first frame end portion positioned outward of the first cover-portion end portion in the axial direction, and wherein the contact member comprises a first pad portion positioned between the first frame end portion and the biasing portion in the axial direction and a second pad portion positioned between the biasing portion and the first cover-portion end portion in the axial direction, the second pad portion being in contact with the first cover-portion end portion and configured to rotate together with the cover portion, the first pad portion being in contact with the first frame end portion and restricted from rotating relative to the first frame end portion.

9. The cartridge according to claim 8, wherein contact of the first pad portion with the first frame end portion of the frame generates a friction therebetween to restrict the first pad portion from rotating relative to the first frame end portion.

10. The cartridge according to claim 1, wherein the frame comprises a first frame end portion positioned outward of the first cover-portion end portion in the axial direction, and wherein the contact member comprises:

a first member configured to be in contact with the first cover-portion end portion; and a second member configured to be in contact with the first member and the first frame end portion.

11. The cartridge according to claim 10, wherein one of the first member and the second member has an opposing portion configured to oppose the other one of the first member and the second member in the axial direction and a protrusion protruding from the opposing portion toward the other one of the first member and the second member, the protrusion being in contact with the other one of the first member and the second member.

12. The cartridge according to claim 10, wherein the second member is restricted from rotating relative to the first frame end portion.

13. The cartridge according to claim 12, wherein contact of the second member with the first frame end portion generates a friction therebetween to restrict the second member from rotating relative to the first frame end portion.

14. The cartridge according to claim 1, wherein the frame comprises a first frame end portion and a second frame end portion opposite to the first frame end portion in the axial direction, and wherein the cover portion further comprises a second cover-portion end portion opposite to the first cover-portion end portion in the axial direction, the first cover-portion end portion being positioned inward of the first frame end portion and the second cover-portion end portion being positioned inward of the second frame end portion in the axial direction, and wherein the contact member comprises:

a first contact member disposed between the first cover-portion end portion and the first frame end portion such that the first contact member is in contact with each of the first cover-portion end portion and the first frame end portion; and a second contact member disposed between the second cover-portion end portion and the second frame end portion such that the second contact member is in contact with each of the second cover-portion end portion and the second frame end portion.

* * * * *